US006116997A

United States Patent [19]

Hakomori et al.

[11] Patent Number: 6,116,997

[45] Date of Patent: Sep. 12, 2000

[54] SINGLE SIDE WORK POLISHING APPARATUS

[76] Inventors: Shunji Hakomori; Hitoshi Nagayama, both of 2647, Hayakawa, Ayase-shi, Japan

[21] Appl. No.: 09/285,342

[22] Filed: Apr. 2, 1999

[30] Foreign Application Priority Data

Apr. 23, 1998 [JP] Japan ..... 10-113495

[51] Int. Cl.[7] ..... B24B 21/18

[52] U.S. Cl. ..... 451/444; 451/56

[58] Field of Search ..... 451/56, 443, 444, 451/49

[56] References Cited

U.S. PATENT DOCUMENTS

| | | | |
|---|---|---|---|
| 5,027,562 | 7/1991 | Kobayashi et al. | 451/11 |
| 5,154,021 | 10/1992 | Bombardier et al. | 451/444 |
| 5,611,943 | 3/1997 | Cadien et al. | 216/88 |
| 5,643,067 | 7/1997 | Katsuoka et al. | 451/444 |
| 5,690,544 | 11/1997 | Sakurai | 451/444 |
| 5,775,983 | 7/1998 | Shendon et al. | 451/444 |
| 5,779,526 | 7/1998 | Gill | 451/324 |
| 5,782,675 | 7/1998 | Southwick | 451/56 |
| 5,785,585 | 7/1998 | Manfredi et al. | 451/288 |
| 5,885,140 | 3/1999 | Hakomori | 451/72 |
| 5,885,147 | 3/1999 | Kreager et al. | 451/443 |
| 5,938,507 | 8/1999 | Ko et al. | 451/56 |

*Primary Examiner*—Joseph J. Hail, III
*Assistant Examiner*—Dermott J. Cooke
*Attorney, Agent, or Firm*—Snell & Wilmer, L.L.P.

[57] ABSTRACT

A single side work polishing apparatus rectifies the surface geometry of a polishing pad during the polishing of a work. A correction roller is mounted to a pressure member that pushes a work against a polishing pad held by a rotating surface plate. The correction roller has a length substantially equivalent to the width of the working area of the polishing pad and is arranged along the radial direction of the surface plate. During polishing, the work and the correction roller are pressed against the polishing pad by the pressure member. The correction roller rotates about its longitudinal axis to rectify the polishing pad while the work is being polished.

10 Claims, 3 Drawing Sheets

SINGLE SIDE WORK POLISHING APPARATUS

TECHNICAL FIELD

The present invention relates to a single side polishing apparatus that polishes the single face of such disk-formed work as semiconductor wafer and magnetic disk substrate.

PRIOR ART

As shown in FIGS. 6 and 7, the single side polisher that polishes one face of the work W, having a surface plate 20, on the working face of which a polishing pad 21 is stuck, and plural pressure plates 22 intended to press the work W against the pad face of the surface plate 20, presses to polish the work W held by these pressure plates against the pad face of the surface plate 20 that rotates.

In such a polishing equipment, the pressure plates 22 are driven to rotate by the differential speed between inner and outer circumferences of the surface plate 20 when polishing, and each work W is polished making a circular motion on the pad face. The contact frequency (contact length) at that time between the work W and the pad face is not uniform over the pad face as a whole, but depends on the radial position of the surface plate 20. That is, the contact frequency is large at the intermediate portions, while it is small on the inner and outer peripheries. As shown in FIG. 8, therefore, the pad face of the surface plate 20 is likely to be worn out into concave form in its intermediate portion of the working area. If polished in that state, the outer periphery of the work is excessively polished causing thus so-called "sags," which will result in reduced flatness.

Usually, the pad face is periodically remedied with a dresser. Since, however, this rectification compels the work polishing process to be interrupted, the production efficiency worsens. This is problematical.

On the other hand, a polishing method making a retainer ring contact with the pad face allows to correct the pad face without ceasing the polishing process. This method, however, is accompanied by a relative motion between the polishing pad and the retainer ring, which will eventually be worn out. This is problematical too.

DISCLOSURE OF THE INVENTION

The principal technical issue of this invention is to provide a work polishing means with high production efficiency that enables to rectification of the pad face of the surface plate, polishing at the same time the one face of the work.

Another technical issue of the invention is to solve the problem of wear as seen in the conventional retainer ring by rectifying the pad face using rotating correction rollers.

To solve such issues as above by this invention, a pressurizing means presses the work against the pad face of rotating surface plate, and at the same time, one or more correction rollers whose length is equivalent to or more than the width of the working area on said pad face are arranged in the radial direction of the surface plate to be pressed thereagainst. A single side polishing method for work is provided, characterized in that simultaneously with the polishing of the work on said pad face, the surface geometry of said pad face is corrected by said rotating correction rollers.

Said correction rollers are driven to rotate with the rotation of the surface plate due to the friction between themselves and the pad face.

The present invention also provides a single side polishing equipment for work, characterized in that in order to implement the foregoing method, the equipment has a freely driven and rotating surface plate to which a polishing pad is stuck; one or more pressurizing means intended to press the disk-shaped work against the pad face of the surface plate; one or more correction rollers having a length at least equivalent to the width of the working area on said pad face, arranged on said pad face in the radial direction of the surface plate, which can rectify the surface shape of said pad face by rotating in contact with said pad face at a certain contact pressure; and a contact pressure setting means for setting the contact pressure of said correction rollers.

According to a preferred constructive embodiment of this invention, provided are the same number of said pressurizing means, correction rollers and contact pressure setting means, where attached to each respective pressurizing means is a correction roller so that it may move up and down freely in association with the contact pressure setting means.

Said contact pressure setting means may be formed of air cylinder.

According to an embodiment of the present invention, said correction rollers are so designed as have a uniform diameter.

According to another embodiment of this invention, said correction rollers are tapered rollers with different diameters at both ends in the axial direction with the end of smaller diameter oriented toward the inner circumference of the surface plate and the end of large diameter toward the outer circumference of the same.

According to yet another embodiment of this invention, said correction rollers are hand-drum shaped with the intermediate portion constricted.

This invention, having such a construction, allows us to polish one face of the work, rectifying at the same time the pad face. Hence, we need not suspend the polishing process working at an excellent production efficiency.

Since said correction is made by pressing the rotating correction rollers against the pad face, the relative motion between said rollers and pad face excludes the wear of said correction rollers ensuring thus superb endurance.

EMBODIMENT

Figure 1:
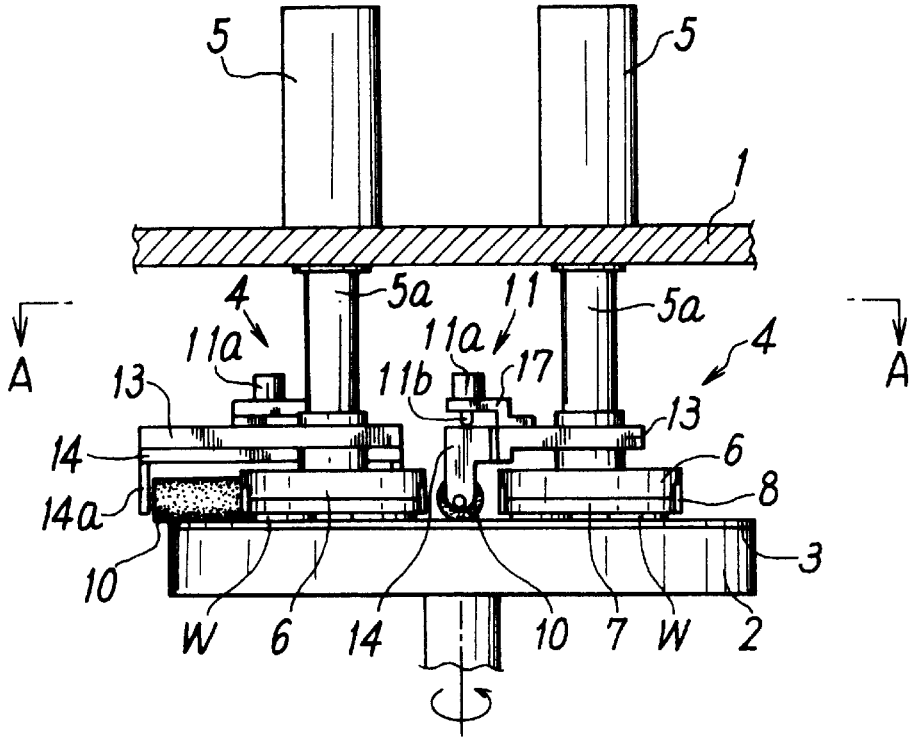
FIG. 1 is a cross-sectional view that shows schematically the essential part of an embodiment of the single side polishing equipment by this invention.
Figure 2:
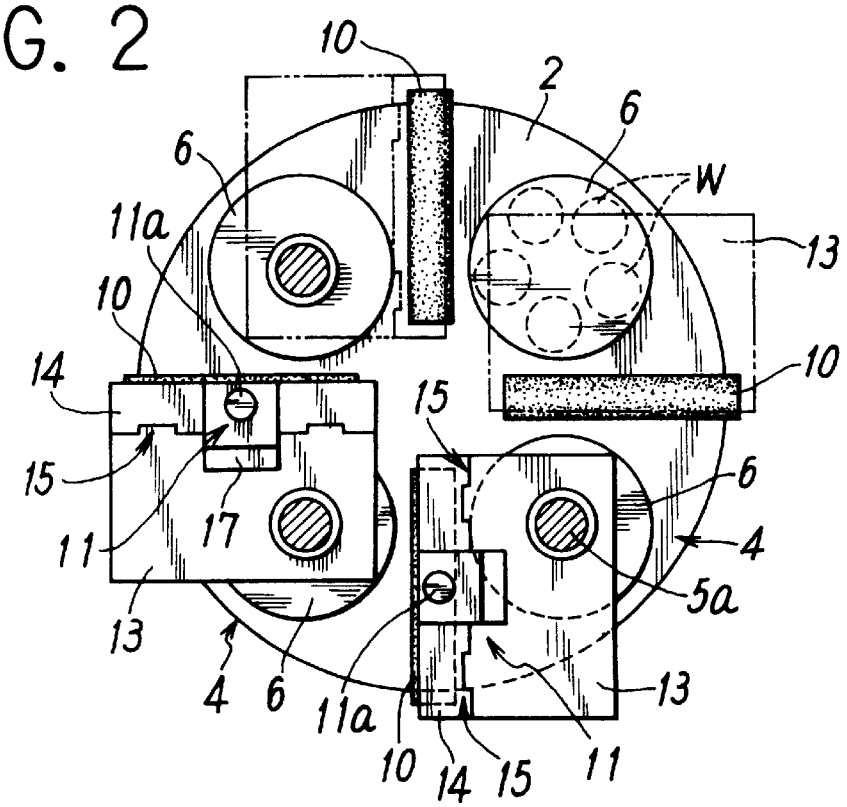
FIG. 2 represents a cross section at II—II line in FIG. 1.

FIG. 1 and FIG. 2 show schematically a preferred embodiment of the single side polishing equipment by this invention. In these figures, the numeral 1 represents the body of the equipment that shows partially a part of the equipment; 2 a surface plate pivotably provided on said body 1; and a polishing pad 3 is stuck on the upper face of said surface plate 2.

The numeral 4 represents a pressurizing means intended to press the disk-formed work W against the pad face of said surface plate 2. This pressurizing means 4, having an air cylinders 5 mounted on the body 1, pressure plates 6 pivotably mounted on the lower end of the rod 5*a* of said air cylinder 5, and a work holding block 7 removably mounted by the retainer ring 8 on the lower face of said pressure plate 6, polishes the work W as stuck on said work holding block 7 by pressing the work against the pad face of the surface plate 2. Because said pressure plate 6 is pivotably mounted on the rod 5*a*, it is driven to rotate with the rotation of the surface plate 2 by the friction between the work W and pad face and by the differential speed between the inner and outer circumferences of the surface plate 2, the respective works W being polished making a circular motion on the pad face.

Said single side polishing equipment is further provided with the correction rollers 10 intended to rectify the pad face of the surface plate 2 and with the contact pressure setting means 11 intended to set the contact pressure with the pad face of said correction rollers 10. These correction rollers 10 and contact pressure setting means 11 are supplied in the same number as said pressurizing means 4, wherein a correction roller 10 and a contact pressure setting means 11 are assembled to a pressurizing means 4.

That is, provided on the rod 5*a* in said pressurizing means 4 above the pressure plate 6 is a supporting member 13, onto which a bracket 14 for supporting the roller is mounted so as to mover freely vertically through the intermediary of a linear guiding mechanism 15. Said correction rollers 10 are mounted pivotably around the horizontal axis between a pair of supporting pieces 14*a* (left) and 14*a* (right) formed on the bracket 14.

Said linear guiding mechanism 15 may be any mechanism if it allows the bracket 14 to move vertically and linearly, which may be composed, for instance, of a rail and a slider that can freely slide along the rail.

Figure 3:
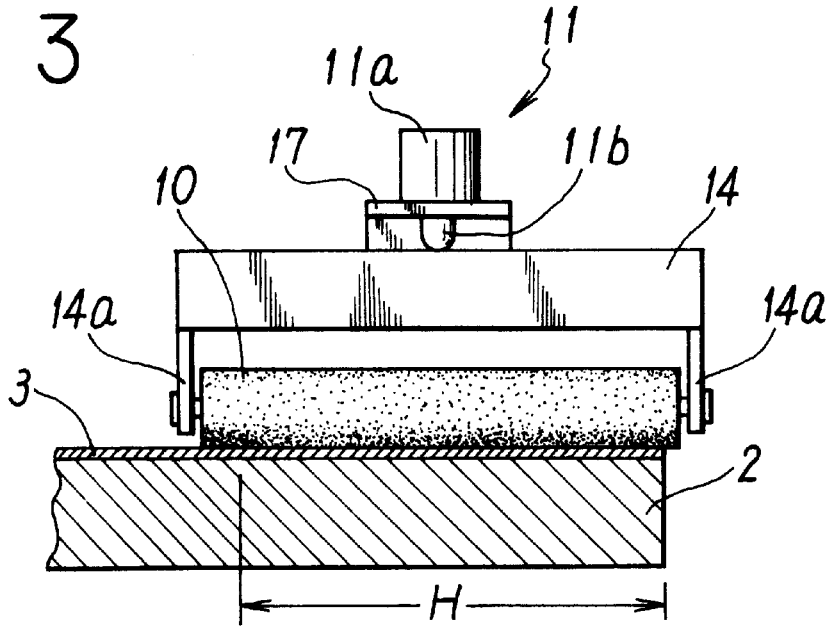
FIG. 3 is a grossly enlarged cross-sectional view of the essential part of FIG. 1.

Said correction rollers 10, made from a synthetic resin element similar to that of the polishing pad 3 is so formed as having a surface harder than said polishing pad 3. The rollers are provided in the radial direction of the surface plate 2 between the neighboring pressure plates 6 and 6 in the respective pressurizing means 4. As is clear also from FIG. 3, the correction roller has a length at least equivalent to the width H of the working area contacting with the work W at the pad face and a uniform diameter over all its length. Contacting with the pad face under certain contact pressure, the roller 10 may rectify the surface geometry of said pad face by drivenly rotating with the rotation of the surface plate 2.

Set up to said supporting member 13 is an air cylinder 11*a* forming said contact pressure setting means 11 through the intermediary of a supporting metal 17. By pressing down said bracket 14 with the rod lib of said air cylinder 11*a,* the correction roller 10 can be pressed against the pad face under certain contact pressure. Said air cylinder 11*a* can regulate said contact pressure by controlling the pressure of the air supplied thereto. It has been so designed that if any precise control of contact pressure is required, the contact pressure may be detected by an appropriate sensor installed on the bracket 14 or the correction roller 10, based on which the supply air pressure can be controlled.

In the single side polisher of the foregoing construction, the work to be polished is pressed against the pad face of the rotating surface plate 2 by the pressure plate in each pressurizing means 4, when also the correction roller 10 is pressed against the pad face under certain contact pressure with the rectification of the pad face by this correction roller 10 made in parallel with the polishing of the work W. Hence, this system does not need any interruption of the polishing process for the correction of the pad face, allowing thereby for good productivity. Since further the correction roller 10 is driven by and rotates with the rotation of the surface plate 2, the relative motion between said correction roller 10 and the pad face prevents the roller 10 from wearing.

In the above embodiment the correction roller 10 has been so designed as to be driven by and rotating with the rotation of the surface plate 2, but some dedicated driving mechanism provided may rotate the roller forcibly. In that case, the correction roller 10 may be made from such element having corrective function as a grindstone to which diamond abrasive grains are electroplated instead of the synthetic resin roller, which only presses down the pad face. Relative motion of this correction roller against the pad face may forcibly form the geometrical shape of said pad face.

Although in the embodiment shown in the drawings plural sets of pressurizing means 4, correction rollers 10 and contact pressure setting means 11 are provided, only a set of them is needed to accomplish the objectives of the invention.

Figure 4:
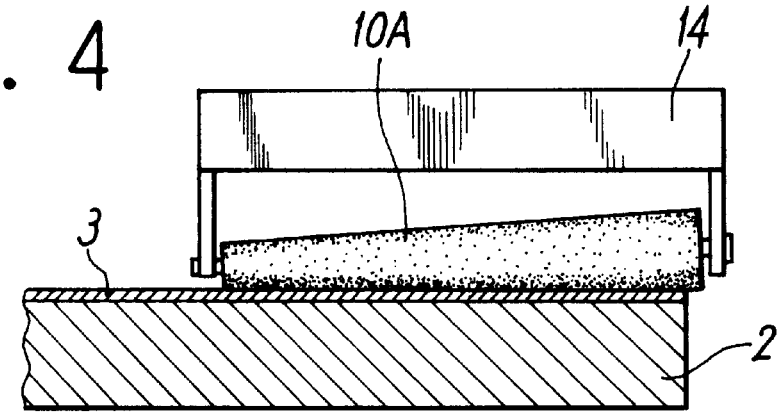
FIG. 4 depicts a cross-sectional view at a similar position to FIG. 3, which shows a second embodiment of the correction roller by this invention.

In FIG. 4 showing the second embodiment of the correction roller, the correction roller 10A is a tapered roller with different diameters at both ends in the axial direction with the end of smaller diameter oriented toward the inner periphery of the surface plate 2 and that of larger diameter toward the outer periphery.

Use of such a tapered correction roller 10A will address a problem of the prior art wherein the correction roller contacts the pad face unevenly due to the differential rotational speed of the surface plate 2 either on the inner or outer circumference of said surface plate 2, a problem which is likely to occur in the case of rollers with uniform diameter. Needless to say, in this case, said tapered correction roller 10A has been so dimensioned as to absorb such differential speed between the inner and outer circumferences of the surface plate 2.

Figure 5:
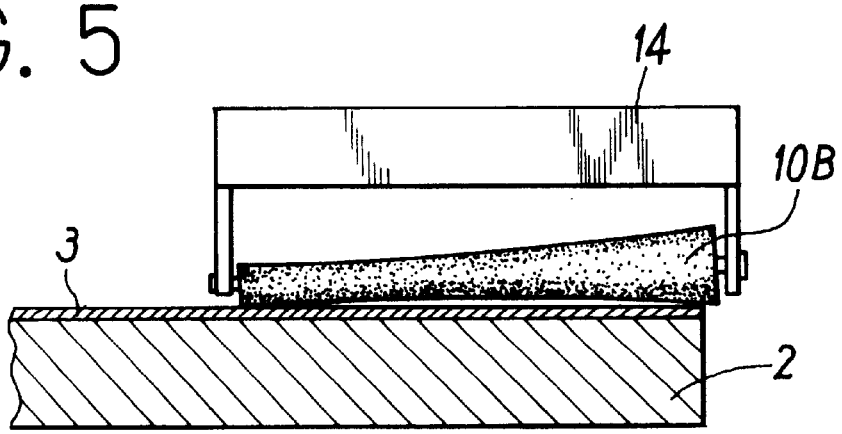
FIG. 5 depicts a cross-sectional view at a similar position to FIG. 4, which shows a third embodiment of the correction roller by this invention.
Figure 6:
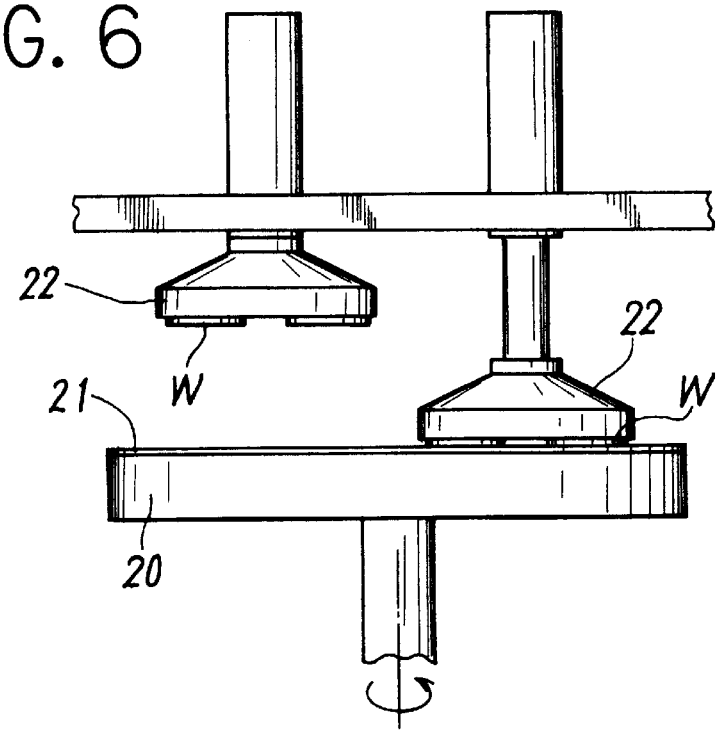
FIG. 6 illustrates a side elevation of the essential part of a conventional single side polisher.
Figure 7:
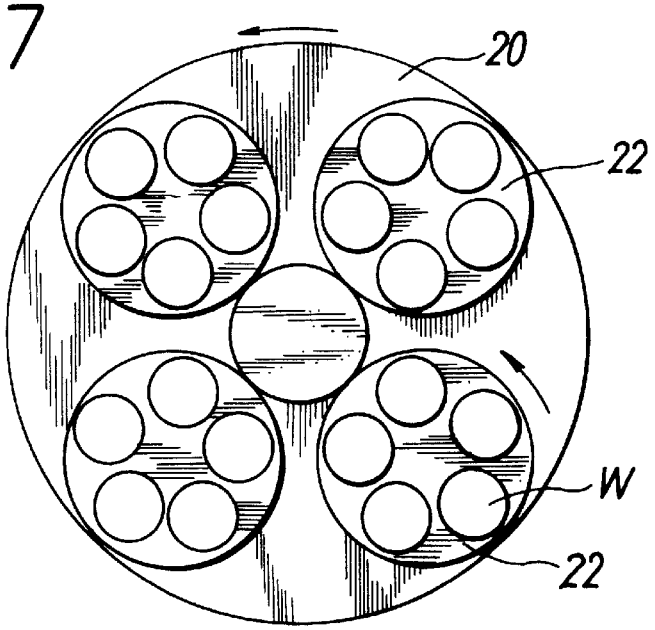
FIG. 7 is a plan view of the essential part of FIG. 6.
Figure 8:
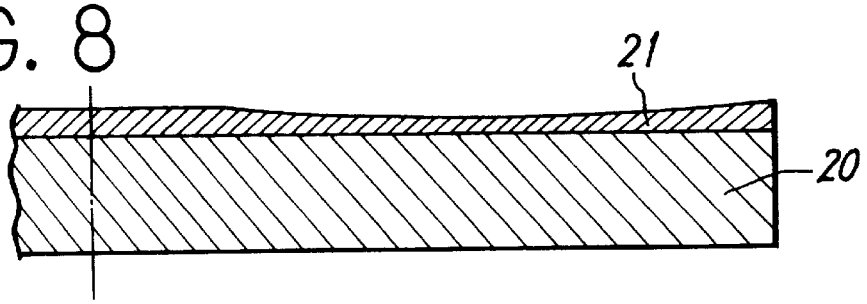
FIG. 8 is a cross-sectional view showing how the surface plate wears out.

The correction rollers 10 and 10A as shown in their respective embodiments are formed into cylindrical or tapered geometrical shape to rectify and flatten the pad face. To rectify the pad face into gently curved, upwardly convexed surface, the correction roller has only to be in the form of a hand drum with its intermediate portion constricted as the correction roller 10B in the third embodiment shown in FIG. 5.

This invention, having such a construction, allows us to polish one face of the work, rectifying at the same time the pad face. Hence, we need not suspend the polishing process working at an excellent production efficiency.

Since said correction is made by pressing the rotating correction rollers against the pad face, the relative motion between said rollers and pad face excludes the wear of said correction rollers ensuring thus superb endurance.

What is claimed is:

1. A single side polishing apparatus comprising:

a freely driven and rotating surface plate;

a polishing pad which is held on said surface plate, wherein said polishing pad has a working area;

at least one pressurizing means for pressing a disk-shaped work against said polishing pad and simultaneously pressing at least one correction roller against said polishing pad wherein said correction roller operatively connected to said pressurizing means and which extends along a radius of said surface plate and has a length substantially equivalent to the width of said working area of said polishing pad; and a contact pressure setting means operatively connected to said pressurizing means;

wherein said correction roller is pressed against said polishing pad by said pressurizing means at a contact pressure determined by said contact pressure setting means and rotated in contact with said polishing pad to rectify the surface geometry of said polishing pad simultaneously throughout the polishing of a workpiece.

2. The single side polishing apparatus of claim 1 wherein said pressurizing means comprises:

an air cylinder having a housing;

a supporting member coupled to said housing of said air cylinder and to said contact pressure setting means; and a bracket coupled to said supporting member and having a longitudinal axis wherein said correction roller is disposed along said longitudinal axis and is rotatably mounted to said bracket;

wherein said contact pressure is applied from said pressurizing means through said supporting member and said bracket to said correction roller to press said correction roller against said polishing pad.

3. The single side polishing apparatus of claim 1 wherein said contact pressure setting means comprises an air cylinder.

4. The single side polishing apparatus of claim 2 wherein said contact pressure setting means comprises an air cylinder.

5. The single side polishing apparatus of claim 1 wherein said correction roller has a uniform diameter.

6. The single said polishing apparatus of claim 2 wherein said correction roller has a uniform diameter.

7. The single side polishing apparatus of claim 1 wherein the diameter of said correction roller tapers axially from a first diameter at a first end of said correction roller disposed proximate to the center of said surface plate to a second larger diameter as a second end of said correction roller disposed proximate to the outside diameter of said surface plate.

8. The single side polishing apparatus of claim 2 wherein the diameter of said correction roller tapers axially from a first diameter at a first end of said correction roller disposed proximate to the center of said surface plate to a second larger diameter at a second end of said correction roller disposed proximate to the outside diameter of said surface plate.

9. The single side polishing apparatus of claim 1 wherein said correction roller has an intermediate portion which does not contact said polishing pad when said correction roller is pressed against said polishing pad by said pressurizing means.

10. The single side polishing apparatus of claim 2 wherein said correction roller has an intermediate portion which does not contact said polishing pad when said correction roller is pressed against said polishing pad by pressurizing means.

* * * * *